US005694100A

United States Patent [19]

Jacquet et al.

[11] Patent Number: 5,694,100

[45] Date of Patent: Dec. 2, 1997

[54] MOTOR VEHICLE STARTER HAVING AN AUXILIARY CONTROL RELAY, AND A CONTACTOR FOR SUCH A STARTER

[75] Inventors: René Jacquet, Lyons; André Liadakis, Salagnon; Bruno Lefebvre, Villeurbanne, all of France

[73] Assignee: Valeo Equipements Electriques Moteur, Creteil, France

[21] Appl. No.: 670,342

[22] Filed: Jun. 25, 1996

[30] Foreign Application Priority Data

Jun. 27, 1995 [FR] France ..... 95 07808

[51] Int. Cl.[6] ..... H01H 67/02

[52] U.S. Cl. ..... 335/120; 335/131; 335/202

[58] Field of Search ..... 335/126, 131, 335/202; 336/192; 439/131

[56] References Cited

U.S. PATENT DOCUMENTS 4,227,231 10/1980 Hansen et al. .
4,644,179 2/1987 Pointout et al. .
5,021,760 6/1991 Krubsack et al. .
5,245,304 9/1993 Zenmei ..... 335/131
5,348,232 9/1994 Babitzka et al. ..... 335/126

FOREIGN PATENT DOCUMENTS 155983 7/1984 European Pat. Off. .

OTHER PUBLICATIONS

French Search Report.

*Primary Examiner*—Lincoln Donovan
*Attorney, Agent, or Firm*—Morgan & Finnegan LLP

[57] ABSTRACT

A motor vehicle starter is of the type comprising an electromagnetic contactor, the winding of which is connected to the positive pole of the battery of the vehicle through an auxiliary control relay, the movable contact of which is arranged to connect electrically together two contact pads which are themselves connected, respectively, to the input terminal of the contactor winding and to the positive contactor terminal, and of the type in which the contactor includes at one of its axial ends a closure hood of insulating material in the general form of a cylindrical pot, with the two terminals of the contactor being disposed in the base of the hood. The auxiliary control relay is disposed inside a housing defined by the contactor hood.

9 Claims, 3 Drawing Sheets

MOTOR VEHICLE STARTER HAVING AN AUXILIARY CONTROL RELAY, AND A CONTACTOR FOR SUCH A STARTER

FIELD OF THE INVENTION

The present invention relates to a starter for the internal combustion engine of a motor vehicle. More particularly, the invention relates to a starter of the kind comprising an electromagnetic contactor, the winding of which is connected electrically to the positive pole of the battery of the vehicle through an auxiliary control relay, the movable output contact of which is arranged to connect electrically together two contact pads of the relay which are connected, respectively, to the input terminal of the contactor winding and to the particular terminal of the contactor that is connected to the positive pole of the battery, the contactor being of the type which includes at one of its axial ends a hood of insulating material in the general form of a pot, with the hood defining a base portion in which the two contactor terminals are disposed.

BACKGROUND OF THE INVENTION

In one known design of motor vehicle starter, use is made of an auxiliary relay for controlling the contact of the starter, whereby control signals can be transmitted with a very low electrical current. As a result of this arrangement, the ignition switch, controlled by the ignition key, no longer has to carry a high intensity current (i.e. a current of several tens of amperes): a current of the order of 1 ampere or less is sufficient to ensure control of the contactor. Because of this arrangement it is possible to reduce the rating of the associated wiring, and to reduce also the size of the switch associated with the ignition key.

In addition, a starter which is equipped with an auxiliary control relay for controlling the contactor may be governed in an easy and inexpensive way by an electronic control circuit which, in particular, can take into account information relating to the state of locking of the steering column lock, and which may include a control and security system which has regard to the operating electrical load of the starter.

In one known arrangement, the auxiliary relay is fixed on the outside, or on the contactor itself, or on the casing of the starter, or again on the support member of the latter, or on an element of the bodywork of the vehicle.

In all of the cases quoted above, the auxiliary control relay has its own protective casing, with appropriate sealing means and its own wiring for connecting the relay to the control circuit and to the contactor. These designs therefore involve particularly high costs and an additional bulk to be accommodated within the engine compartment of the vehicle.

DISCUSSION OF THE INVENTION

An object of the present invention is to propose a new design for a starter of the general type mentioned above, which enables these various drawbacks to be overcome.

According to the invention in a first aspect, a starter for a motor vehicle, of the type comprising an electromagnetic contactor, the winding of which is connected to the positive pole of the battery of the vehicle through an auxiliary control relay, the movable contact of which is adapted to connect together two contact pads which are connected respectively to the input terminal of the winding and to the terminal of the contactor that is connected to the positive pole of the battery, and of the type in which the contactor comprises an axial terminal hood of insulating material, in the general form of a pot, and in the base portion of which the two terminals of the contactor are arranged, is characterised in that the hood of the contactor includes an extension in which is formed a housing which receives the auxiliary control relay.

The said extension preferably extends radially outwardly from a lateral skirt portion of the hood. The extension is then preferably delimited by an axial end wall which lies in substantially the same plane as the base portion of the hood, and by a lateral wall which extends the lateral skirt portion of the hood.

The said extension is preferably open into the interior of the hood itself (i.e. the pot-shaped element).

According to a preferred feature of the invention, the said extension has an open face parallel to its axial end face and substantially coplanar with the open face of the hood, i.e. the mouth of the pot-shaped element, the open face of the extension being obturated by a plate which forms a radial inward extension of the hood, and which is held between the hood and the contactor.

The two power supply terminals for the winding or coil of the auxiliary control relay preferably project through the hood. In preferred embodiments of the invention where this feature is present, and in which the said extension extends radially outwardly from a lateral skirt portion of the hood and is delimited by an axial end wall, substantially coplanar with the base portion of the hood, and by a lateral wall extending the said skirt portion, the said axial end wall of the hood is formed with two holes through which there pass the power supply terminals for the relay coil.

According to a further preferred feature of the invention, the various electrical connections that connect the auxiliary control relay electrically to other elements, and in particular to its power supply terminals and/or to the contactor winding and contactor terminal, are made in the form of a metal stamping or pressing which constitutes an electrical circuit, and which is embedded in the insulating material of which the hood is moulded.

According to the invention in a second aspect, a contactor is provided for a motor vehicle starter, the contactor having the features specified above for a contactor of a starter according to the said first aspect of the invention.

Further features and advantages of the invention will appear more clearly on a reading of the following detailed description of a preferred embodiment of the invention, which is given by way of example only and for an understanding of which, reference is made to the accompanying drawings.

DESCRIPTION OF A PREFERRED EMBODIMENT OF THE INVENTION

Figure 1:
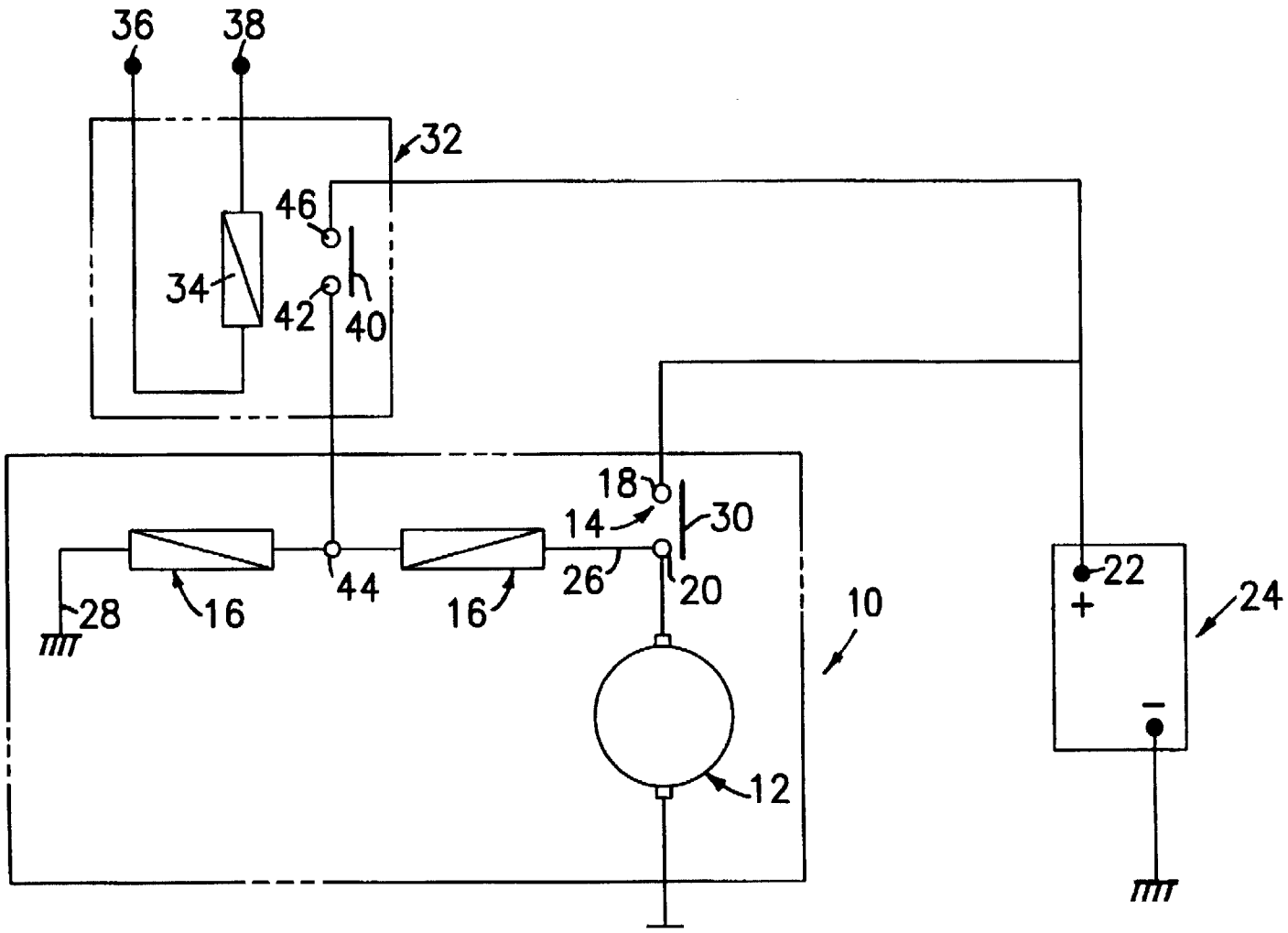
FIG. 1 is an electrical block diagram which shows the arrangement of an auxiliary control relay for a motor vehicle starter.

FIG. 1 shows diagrammatically an electrical circuit in which a starter 10 includes an electric starter motor 12 and an electromagnetic contactor 14. The electromagnetic contactor 14 comprises in particular, and in accordance with an arrangement known per se, a winding or coil 16 and two contactor terminals 18 and 20. The terminal 18 is an input terminal which is connected to the positive pole 22 of the battery 24 of the vehicle, while the terminal 20 is connected to the starter motor 12 and, through a connection 26, to the winding 16. The winding 16 is also connected, through a connection 28, to the electrical ground or earth of the vehicle.

The contactor 14 has a movable contact 30 which, when the contactor 14 is supplied with power, sets up an electrical connection between the terminals 18 and 20 and thus causes the starter motor 12 to be supplied with power by the battery 24.

In accordance with an arrangement known per se, control of the contactor 14, that is to say the power supply for the coil 16, is obtained by means of an auxiliary control relay 32, which comprises a relay winding or coil 34, the two power supply terminals 36 and 38 of which are connected to a control circuit (not shown) which is a low current-control circuit. When power is supplied to the relay coil 34, the latter causes the movable relay contact 40 to be displaced, and this establishes electrical connection between a first contact pad 42, which is connected to the midpoint 44 of the winding 16 of the contactor 14, and a second contact pad 46 which is connected to the positive pole 22 of the battery 24.

One embodiment of the invention will now be described, consisting of a starter with its contactor shown in FIGS. 2 to 6, in which those components already described with reference to FIG. 1 will be designated by the same reference numerals.

Figure 2:
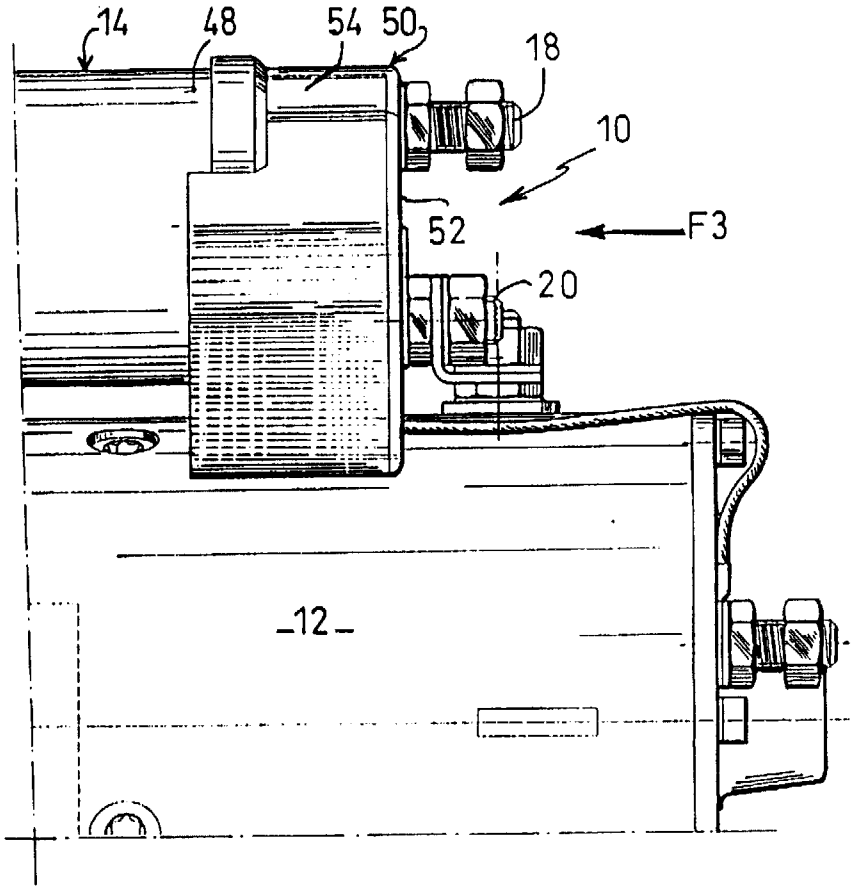
FIG. 2 is a partial side, or axial, view of one end of a starter and its contactor, made in accordance with the present invention.
Figure 3:
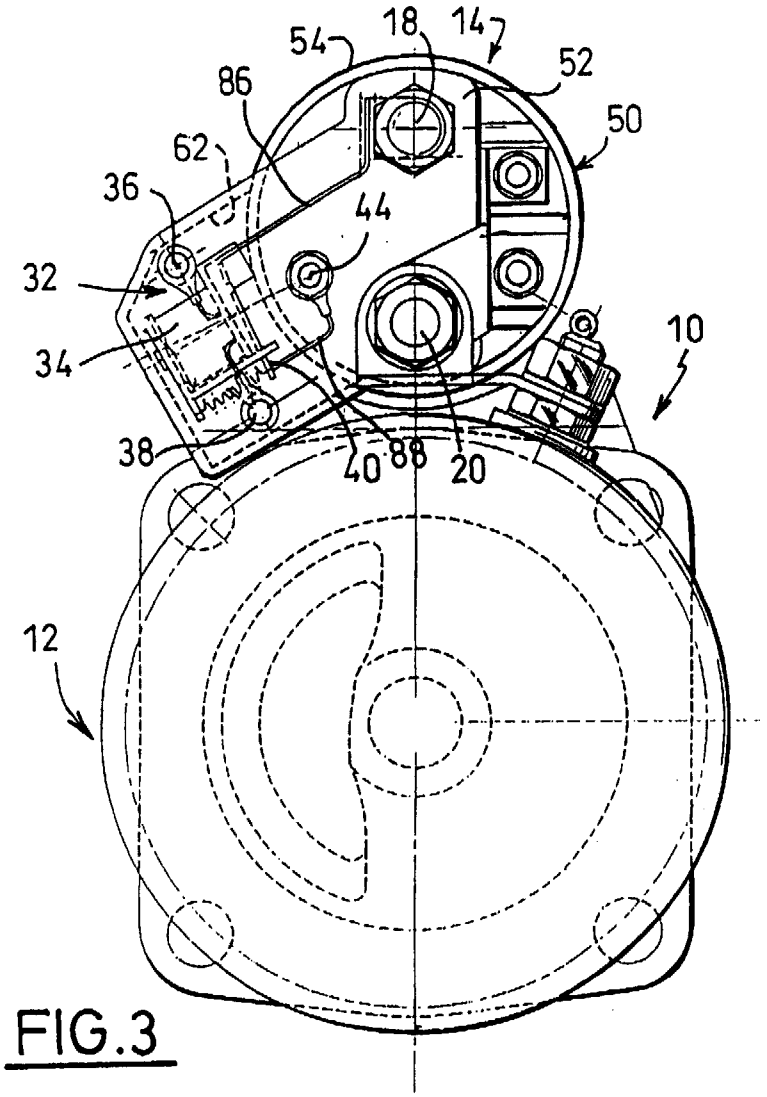
FIG. 3 is an end view in the direction of the arrow F3 in FIG. 2.
Figure 4:
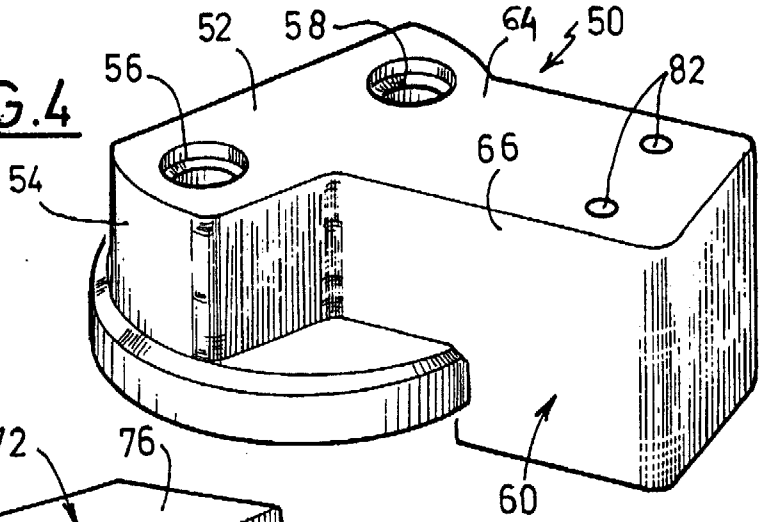
FIG. 4 is an outside perspective view of the hood of the contactor shown in FIGS. 2 and 3.
Figure 5:
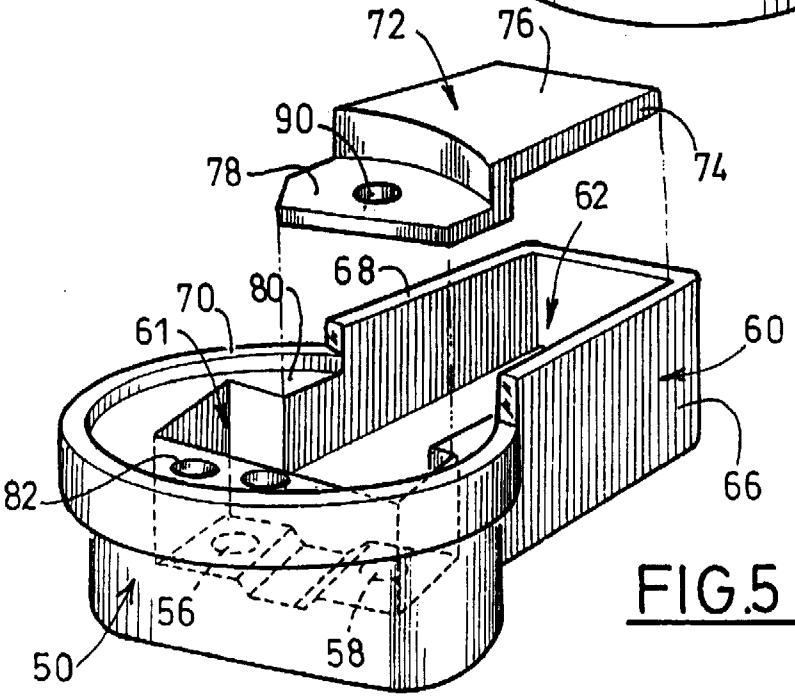
FIG. 5 is a perspective view of the interior of the hood with its closure plate, shown in exploded form.
Figure 6:
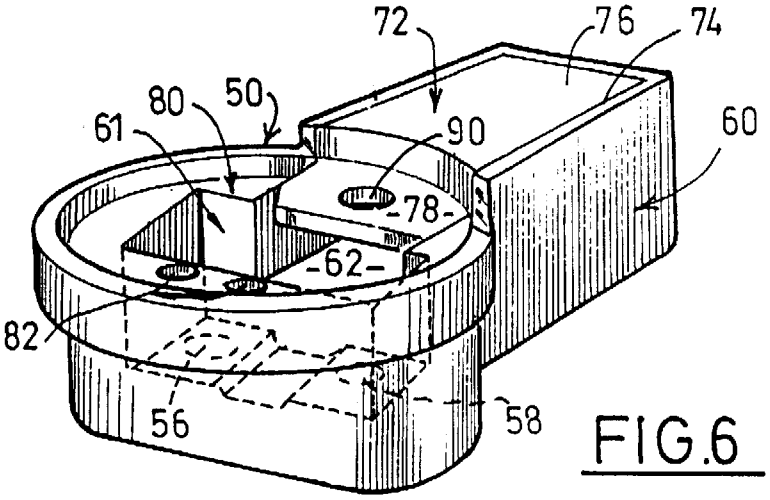
FIG. 6 is a view similar to that in FIG. 5, in which the closure plate is shown in its fitted position in which it closes the housing of the auxiliary relay.

In accordance with a design known per se, the contactor 14 shown in FIGS. 2 and 3 consists essentially of a cylindrical armature defining a casing 48, one end of which is closed by a hood 50. The hood 50 is a moulded component made of an insulating material in the form of a cylindrical pot having a transverse base portion 52 and an annular cylindrical skirt portion 54. As can be seen in FIGS. 4 to 6, in which only the moulded plastics body of the hood 50 is shown, the base portion 52 is formed with two holes 56 and 58 through which the terminals 18 and 20 extend.

The side wall 54 of the hood 50, in the current state of the art, delimits an internal cavity 61 in which, in particular, the movable contact 30 of the contactor 14 is displaceable.

The hood 50 has a radial extension 60 which delimits an internal housing 62 in which the auxiliary control relay 32 is received. As can be seen in particular in FIGS. 4 to 6, the extension 60 extends substantially radially outwardly, and it has the general form of a rectangular parallelepiped. It is delimited by a transverse end wall 64 which is coplanar with the base portion 52 of the hood 50, and by a side wall 66 of rectangular contour, which constitutes an extension to the generally cylindrical side wall 54 of the hood 50.

As can be seen in FIG. 5, the extension 60 thus has an open transverse face 68 which is parallel to its base 64, and which lies substantially in the same plane as the transverse end face 70 of the hood 50. The cavity 62 is closed by an insert member 72, the contour 74 of which is complementary to that of the open face 68. The main body 76 of the insert member 72 is in the form of a plate, which is extended radially inwardly by a lug 78 which is offset slightly in the axially inward direction. The lug 78 is coplanar, in the fitted position shown in FIG. 6, with the front transverse end face 80 of the hood 50.

As can be seen in FIG. 3, the relay 32 is arranged in the housing 62 formed in the extension 60. The power supply terminals 36 and 38 for the coil 34 of the relay 32 project out of the housing through holes 82 which are formed in the base portion 64 of the extension 60.

A first electrical connector 86 connects the contact pad 46 of the relay 32 to the terminal 18 of the contactor, while a second electrical connection 88 connects the other contact pad 42 of the relay to the midpoint 44 of the contactor winding 16. The electrical connections 86 and 88 are shown in FIG. 3 in the form of metallic components formed by stamping and bending. They may however consist of wires or cables, or they may be replaced by a printed circuit or by a cut-out metal component constituting a circuit network and embedded in the insulating plastics material of which the hood 50, with its extension 60, is made.

In the fitted position of the hood 50 on the armature 14, the plate 76 that constitutes the insert member 72 is held between the body of the contactor 14 and the hood 50. It is fixed against the contactor by the mid-point terminal 44 (FIGS. 1 and 3), which is received in a hole 90 (FIG. 5) formed in the lug 78.

It is possible to complete the sealing of the insert member 72 by depositing a band of adhesive or mastic material on the junction line between the insert member 72 and the extension 60.

The foregoing description, and the drawings, illustrate the fact that the invention accordingly proposes a particularly compact design for the contactor, with an integrated auxiliary contact relay. This design enables the relay 32 to be protected to the same standard of sealing as that which is provided for protection of the movable contact 30 and the terminals 18 and 20.

It will be noted that no electrical connection is visible on the outside of the contactor 14 for connecting the relay 32 to the other components of the contactor.

The invention is not limited to the embodiment which has just been described, and the moulded forms of the hood 50 with its integral extension or projecting portion 60 can, in particular, be varied by a considerable amount without departing from the scope of the invention, according to which the relay 32 is integrated in a part of the hood 50 of the contactor.

What is claimed is:

1. A starter for a motor vehicle having a battery with positive and negative poles, the starter including an electromagnetic contactor having a winding, an input terminal of the winding, and a pair of contactor terminals, the contactor further having axial ends and a terminal hood at one of its axial ends, the hood being of an insulating material and having the general form of a pot, the hood defining a base portion of the hood, the two said contactor terminals being disposed in the said base portion of the hood, the said contactor terminals including a first contactor terminal for connection to the positive pole of the battery, the starter further including an auxiliary control relay having a first contact pad and a second contact pad and connecting means electrically connecting the said first contact pad to the said winding input terminal and the said second contact pad to the said first contactor terminal, the relay further having a movable contact for making and breaking electrical connection between its two said contact pads, wherein the said hood includes an extension defining a housing, the said relay being disposed in the said housing.

2. A starter according to claim 1, wherein the hood has a lateral skirt portion, the said extension of the hood extending radially outwardly from the said skirt portion.

3. A starter according to claim 2, wherein the hood further includes a base portion defining a plane, the said extension of the hood defining an axial end wall lying substantially in the said plane of the base portion of the hood, and a side wall extending the said skirt portion of the hood.

4. A starter according to claim 3, wherein the said extension of the hood is open into the interior of the hood.

5. A starter according to claim 3, wherein the hood has a first open face and the extension of the hood has a second open face, the said second open face being parallel to the said axial end face of the extension and substantially coplanar with the said open face, the starter further including a plate element obturating the said first open face and lying within the hood, being of a length such as to be held between the hood and the contactor.

6. A starter according to claim 1, wherein the said relay has a relay coil and two power supply terminals, the relay coil being connected between the said power supply terminals, with the power supply terminals projecting through the hood.

7. A starter according to claim 2, wherein the hood further includes a base portion defining a plane, the said extension of the hood defining an axial end wall lying substantially in the said plane of the base portion of the hood, and a side wall extending the said skirt portion of the hood, the said relay having a relay coil and two power supply terminals, with the relay coil being connected between the said power supply terminals, the power supply terminals projecting through the hood, and wherein the said axial end wall defines two holes, each said power supply terminal of the relay extending through a respective one of the said two holes.

8. A starter according to claim 1 having electrical connecting elements connecting the said relay to other elements of the starter, the said connecting elements constituting a circuit made of stamped-out metal and embedded in the insulating material of the hood.

9. A contactor for a starter according to claim 1, the said contactor being an electromagnetic contactor having a winding, an axial terminal hood of insulating material having the general form of a pot and defining a base portion, and two contactor terminals disposed in the said base portion, the hood further including an extension defining a housing for receiving the auxiliary control relay of the starter.

* * * * *